US010047541B2

(12) United States Patent
Lai

(10) Patent No.: US 10,047,541 B2
(45) Date of Patent: Aug. 14, 2018

(54) DUAL LOCKING SYSTEM WITH USER CONTROLLABLE PLATE

(71) Applicant: THE SUN LOCK COMPANY, LTD., Tuen Mun, N. T. (HK)

(72) Inventor: Karl Lai, Tai Po (HK)

(73) Assignee: THE SUN LOCK COMPANY, LTD., Tuen Mun, N.T. (HK)

( * ) Notice: Subject to any disclaimer, the term of this patent is extended or adjusted under 35 U.S.C. 154(b) by 143 days.

(21) Appl. No.: 15/155,382

(22) Filed: May 16, 2016

(65) Prior Publication Data

US 2017/0073999 A1 Mar. 16, 2017

Related U.S. Application Data

(60) Provisional application No. 62/219,285, filed on Sep. 16, 2015.

(51) Int. Cl.

| | |
|---|---|
| ***E05B 37/00*** | (2006.01) |
| ***E05B 37/02*** | (2006.01) |
| ***E05B 67/24*** | (2006.01) |
| ***E05B 35/10*** | (2006.01) |
| ***E05B 17/14*** | (2006.01) |

(52) U.S. Cl.

CPC ..... *E05B 37/0031* (2013.01); *E05B 17/145* (2013.01); *E05B 35/105* (2013.01); *E05B 37/025* (2013.01); *E05B 67/24* (2013.01)

(58) Field of Classification Search

CPC .. E05B 37/025; E05B 37/0031; E05B 17/145; E05B 35/105; E05B 67/24

USPC ..... 70/21, 25, 284, 285, 455, 423, 425, 426

See application file for complete search history.

(56) References Cited

U.S. PATENT DOCUMENTS

| | | | | | |
|---|---|---|---|---|---|
| 3,732,711 | A | * | 5/1973 | Albert | E05B 17/145 70/287 |
| 3,823,584 | A | * | 7/1974 | Gill | E05B 67/22 70/21 |
| 4,365,491 | A | * | 12/1982 | Rubinstein | E05B 17/145 70/288 |
| 4,541,260 | A | * | 9/1985 | Rubinstein | E05B 17/145 70/288 |
| 4,773,243 | A | * | 9/1988 | Lukich | E05B 17/145 70/425 |
| 4,793,165 | A | * | 12/1988 | Rochman | E05B 17/145 70/284 |
| 5,715,709 | A | | 2/1998 | Lai | |
| 5,732,842 | A | * | 3/1998 | Krause | B60K 15/05 141/383 |
| 6,029,481 | A | | 2/2000 | Lai | |
| 6,035,672 | A | | 3/2000 | Lai | |
| 6,164,096 | A | | 12/2000 | Lai | |
| D439,824 | S | | 4/2001 | Lai | |

(Continued)

*Primary Examiner* — Suzanne L Barrett

(74) *Attorney, Agent, or Firm* — Ware, Fressola, Maguire & Barber LLP

(57) ABSTRACT

A dual locking system including a combination mechanism and a key mechanism is provided, including a control plate to control access to the key mechanism. When the control plate is positioned in a blocking position, the control plate blocks access to the key hole of the key mechanism. The control plate can be released from the blocking position by turning the dials of the combination mechanism to the correct combination. The released control plate can be moved to an exposure position, which allows access to the key hole.

9 Claims, 8 Drawing Sheets

(56) References Cited

U.S. PATENT DOCUMENTS

| | | | | |
|---|---|---|---|---|
| D439,825 | S | 4/2001 | Lai | |
| D448,273 | S | 9/2001 | Lai | |
| D451,002 | S | 11/2001 | Lai | |
| 6,408,660 | B1 | 6/2002 | Lai | |
| 6,474,116 | B1 | 11/2002 | Lai | |
| D472,790 | S | 4/2003 | Lai | |
| 6,675,614 | B2 | 1/2004 | Lai | |
| 6,729,166 | B1 | 5/2004 | Lai | |
| 6,742,366 | B1 | 6/2004 | Lai | |
| D498,132 | S | 11/2004 | Lai | |
| 6,883,355 | B2 | 4/2005 | Lai | |
| D511,673 | S | 11/2005 | Lai | |
| 7,117,698 | B2 | 10/2006 | Lai | |
| 7,140,209 | B2 | 11/2006 | Lai | |
| 7,225,648 | B2 * | 6/2007 | Lai | E05B 35/105 70/21 |
| 7,269,985 | B2 | 9/2007 | Lai et al. | |
| 7,467,529 | B1 | 12/2008 | Lai et al. | |
| 7,467,531 | B2 | 12/2008 | Lai et al. | |
| 7,562,545 | B2 | 7/2009 | Lai et al. | |
| 7,685,851 | B2 | 3/2010 | Lai | |
| 7,765,840 | B2 | 8/2010 | Lai et al. | |
| 8,096,150 | B2 | 1/2012 | Lai et al. | |
| 8,261,583 | B2 | 9/2012 | Lai et al. | |
| 8,511,118 | B2 | 8/2013 | Lai et al. | |
| 8,661,861 | B2 | 3/2014 | Lai | |
| 8,776,556 | B2 | 7/2014 | Lai | |
| 8,826,703 | B2 | 9/2014 | Lai | |
| 8,919,155 | B2 | 12/2014 | Lai | |
| 8,931,313 | B2 * | 1/2015 | Lai | E05B 35/105 70/21 |
| 9,194,158 | B2 | 11/2015 | Lai | |

* cited by examiner

DUAL LOCKING SYSTEM WITH USER CONTROLLABLE PLATE

CROSS-REFERENCE TO RELATED APPLICATIONS

The present application claims the benefit of U.S. Provisional Patent Application No. 62/219,285 filed Sep. 16, 2015, which is hereby incorporated by reference in its entirety.

TECHNICAL FIELD

The present invention relates to a padlock having a dual locking system.

BACKGROUND OF THE INVENTION

The present invention relates to a dual locking system with a user controllable plate that is enclosed in a locking body/housing.

The current market has many Transportation Security Administration ("TSA") luggage locks that are able to let the TSA agent to open the lock with an overriding key mechanism. The benefits of this approach include that the lock will not be cut and it allows the TSA official access the luggage for inspection. However, a drawback occurs if the user is in an environment that does not require any luggage inspection, at which point the key hole becomes a break point to the lock. In particular, a current problem occurs when 3-D printed copies of a pass key have been made. This allows a thief to copy the keys and then use the copies to break into luggage and take any valuable items from the luggage. To prevent this from occurring, it is important to prevent anyone from using the key mechanism in a non-inspection environment, such as when a traveler is staying in a hotel, which does not require the key mechanism during that time.

SUMMARY OF THE INVENTION

The present invention provides a dual-locking system that includes a control plate fully controlled by the combination lock user. The user can slide the control plate to seal the key hole, which will immediately restrict anyone from accessing the padlock, even those with a key. If the luggage will be inspected in a travel environment, such as in an airport, the user can slide the control plate to one direction (e.g., to the right) such that the key hole of the padlock and cylinder are exposed, which allows a TSA agent to inspect luggage if needed. The control plate is configured for a sliding left-right movement when the lock is opened by the combination code. This means that the control plate is entirely controlled by the user. This is an important feature, as when the user is not required to have the luggage inspected, the user can simply slide the control plate to seal the cylinder hole and to restrict anyone from touching the cylinder and accessing the padlock via the key mechanism. If the user needs the lock to be inspected in the airport then he or she can slide the control plate such that the cylinder will be exposed and allow inspection of the luggage. The dual locking function can be the same as that described applicant's U.S. Pat. No. 7,140,209, which is hereby incorporated by reference.

According to a first aspect of the present invention, a locking apparatus is provided comprising a primary locking mechanism comprising a combination mechanism, a secondary locking mechanism comprising a key mechanism comprising a key entrance hole and a control plate configured to block access to the key entrance hole in a first, blocking position. The combination mechanism is configured to control movement of the control plate by permitting movement of the control plate to a second, exposure position to expose the key entrance hole when the locking apparatus is opened by the combination mechanism.

According to a first embodiment of the locking apparatus of the first aspect of the invention, the locking apparatus is a padlock. The padlock comprises a lock body and a shackle, and the lock body comprises openings to receive the shackle. A first, long leg of the shackle is retained inside the lock body and a second leg of the shackle can be released from the lock body from a first locked position to a second opened position by upward movement, when the padlock is opened by the combination mechanism or the key mechanism.

According further to the first embodiment of the locking apparatus of the present invention, the control plate comprises at least one cut out section and a wall configured to block access to the key hole. When the control plate is in the first, blocking position, the long leg of the shackle is engaged with the control plate in a manner that prevents movement of the control plate. Opening the padlock by way of the combination mechanism releases the long leg of the shackle from engagement with the control plate and permits movement of the control plate in a first direction out of the first, blocking position. Movement of the control plate in the first direction is configured to align the long leg of the shackle and a first cut out section of the control plate, such that a subsequent locking of the padlock causes the long leg of the shackle to engage the first cut out section of the control plate in a manner that prevents movement of the control plate, and secures the control plate in the second, exposure position. Opening the padlock by way of the combination mechanism releases the long leg of the shackle from the first cut out section of the control plate and permits movement of the control plate in a second direction toward the first, blocking position According to further to the first embodiment of the locking apparatus of the present invention, the first cut out section of the control plate can be a hole through the control plate dimensioned to receive the long leg of the shackle. Further, when the control plate is in the first, blocking position, the long leg of the shackle can be engaged with a second cut out section of the control plate in a manner that prevents movement of the control plate.

The locking apparatus according the first embodiment of the invention may further comprise a plurality of clutches, a plurality of dials to control rotational movement of the plurality of clutches, a cam, a cylinder connected to the cam and configured to control movement of the cam, and a blocking plate connected to the cam and configured to control the movement of the second leg of the shackle.

The control plate may further comprise a projection configured to assist in movement of the control plate.

In accordance with a second embodiment of the locking apparatus according to the first aspect of the invention, the locking apparatus is a zipper lock.

According to a second aspect of the invention, a control plate is provided for use in a lock having a combination mechanism and a key mechanism. The control plate is configured to be controlled by the combination mechanism and comprises at least one cut out section; and a wall to block a key entrance hole of the lock when the control plate is in a first, blocking position.

In certain embodiments of the control plate of the second aspect of the invention, the control plate may comprise two cut out sections, each configured to engage a long leg of a shackle. A first cut out section of the control plate is configured to engage the long leg of the shackle to prevent the control plate from moving in a first direction out of the blocking position to an exposing position. A second cut out section of the control plate is configured to engage the long leg of the shackle to prevent the control plate from moving in a second direction to the blocking position from the exposing position. Movement of the control plate is permitted by opening the lock by the combination mechanism, and to move the control plate, the combination mechanism must be in a lock open mode, wherein when the shackle is being pulled upward, as the shackle is in upward position then the user can freely slide the control plate. The second cut out section can be a hole through the control plate dimensioned to receive the long leg of the shackle.

DETAILED DESCRIPTION OF THE FIGURES

Figure 1:
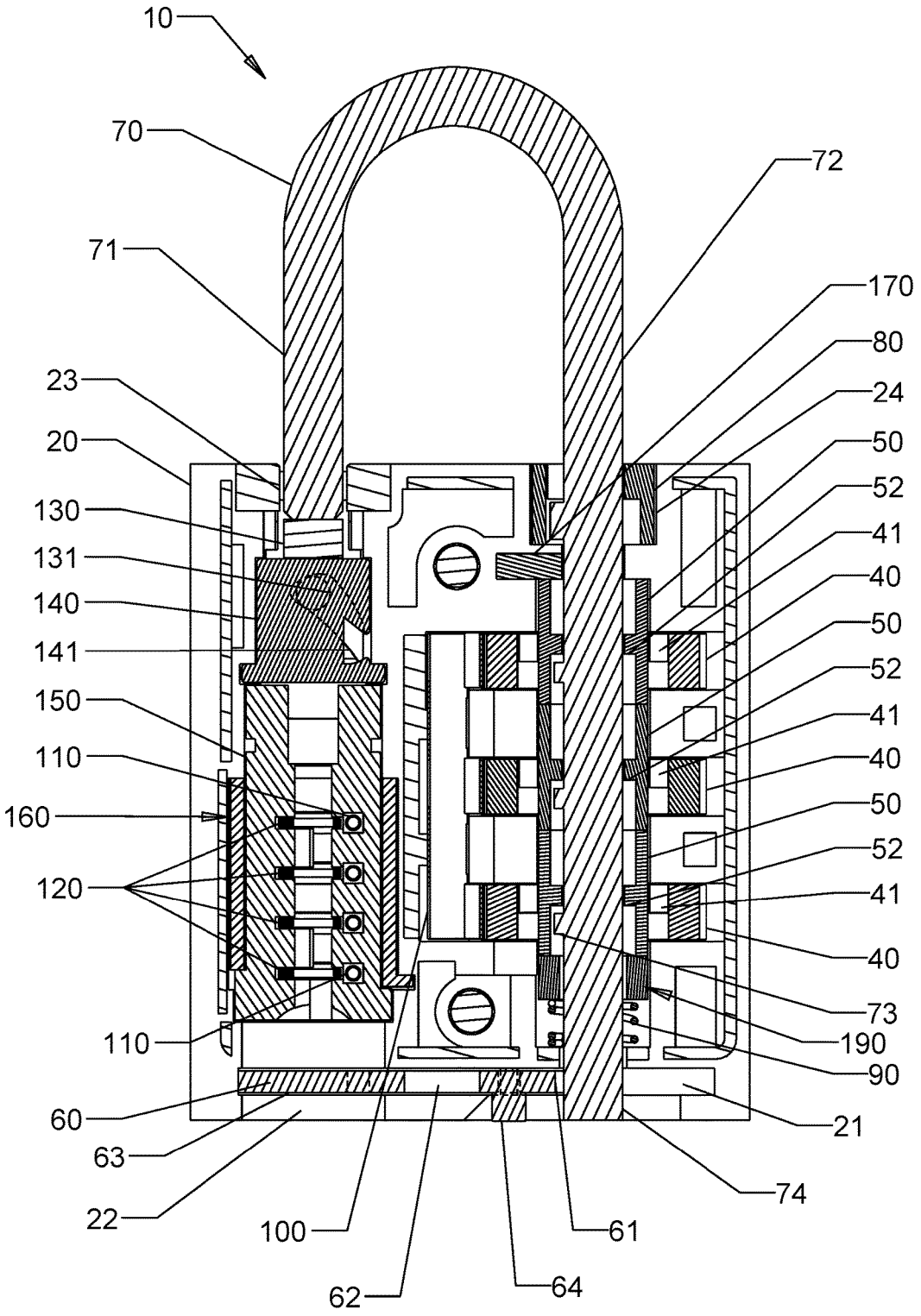
FIG. 1 shows a padlock according to a first embodiment of the invention in locked mode with the control plate in blocking mode.

According to the present invention, a padlock 10 is provided, which can be opened by combination mechanism 190 and key mechanism 160. The combination mechanism 190 is controlled by dials 40, and when all dials 40 have been turned to the preset lock-opened combination, the opening-gap 51 of clutches 50 will align with the protrusion 73 of the shackle 70, which lets the user lift the shackle 70 and open the padlock 10. The key mechanism 160 is controlled by a disc tumbler cylinder 150. As a correct key 180 enters, the cylinder 150 turns and the cam 140 adjacent the cylinder 150 will turn in the same manner. As the cam 140 turns, the cam 140 moves the blocking plate 130 downward, as the pin 131 of the blocking plate 130 is driven by the slot 141 of the cam 140 downward. The rotational movement of the cylinder 150 transfers to the cam 140, and the relationship between the slot 141 of the cam 140 and the pin 131 of the blocking plate 130 will then transfer the rotational movement from the cam 140 to the vertical (upward and downward relative to the orientation of the padlock 10 in FIG. 1) movement of the blocking plate 130.

FIG. 1 shows an example of the padlock 10 in locked mode with the control plate 60 in blocking mode. In blocking mode, the control plate 60 blocks access to the cylinder 150.

In the locked mode, the combination dials 40 are not aligned in the lock-opened combination and therefore, the opening-gap 51 of the clutch 50 is not aligned with the protrusions 73 of the shackle 70. The protrusions 73 of the shackle 70 are underneath the locking-zone 52 of the clutch 50. This will cause the short-leg 71 of the shackle 70 to stay inside of the locking hole 23 of the lock body 20.

Figure 4:
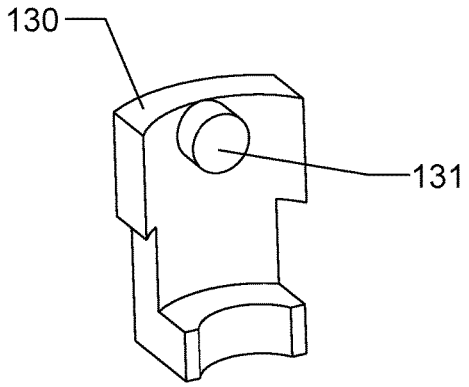
FIG. 4 shows a blocking plate of the padlock according to the first embodiment of the invention.
Figure 5:
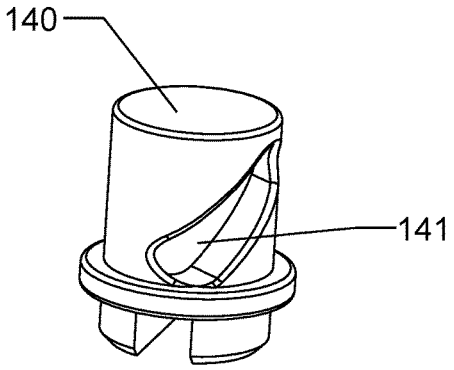
FIG. 5 shows a cam of the padlock according to the first embodiment of the invention.
Figure 6:
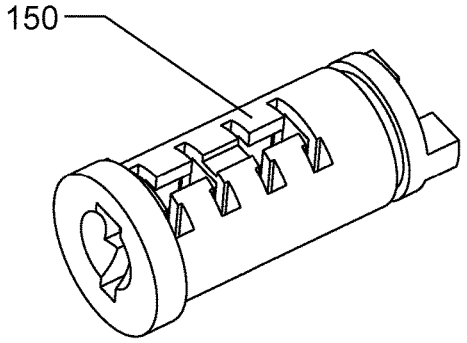
FIG. 6 shows a cylinder of the padlock according to the first embodiment of the invention.

In the locked mode, the key 180 is not present in the cylinder 150 and the cylinder 150 and cam 140 cannot cause the blocking plate 130 to move downward. Examples of the blocking plate 130, cam 140 and cylinder 150 are shown in FIGS. 4, 5 and 6, respectively. Moreover, the control plate 60 is located below the cylinder 150 and the wall 63 of the control plate 60 is blocking the key entrance hole 22 of the lock body 20. In this regard, an intruder cannot place a key or even a key lock picking device to open the padlock 10 via cylinder 150, which increases the level of security, especially when the padlock 10 is not required to be inspected. In such a locked mode, the tip 74 of the long leg 72 of the shackle 70 is engaged to a second cut out section 61 of the control plate 60. In such a position, nobody can slide the control plate 60 to expose the key entrance hole 22 of the lock body 20. The wall 63 of the control plate 60 will block key entrance hole 22 of the lock body 20. The control plate 60 sits in a channel 21 of the lock body 20. The channel 21 allows the control plate 60 to move in between the blocking mode and exposure mode.

Figure 7:
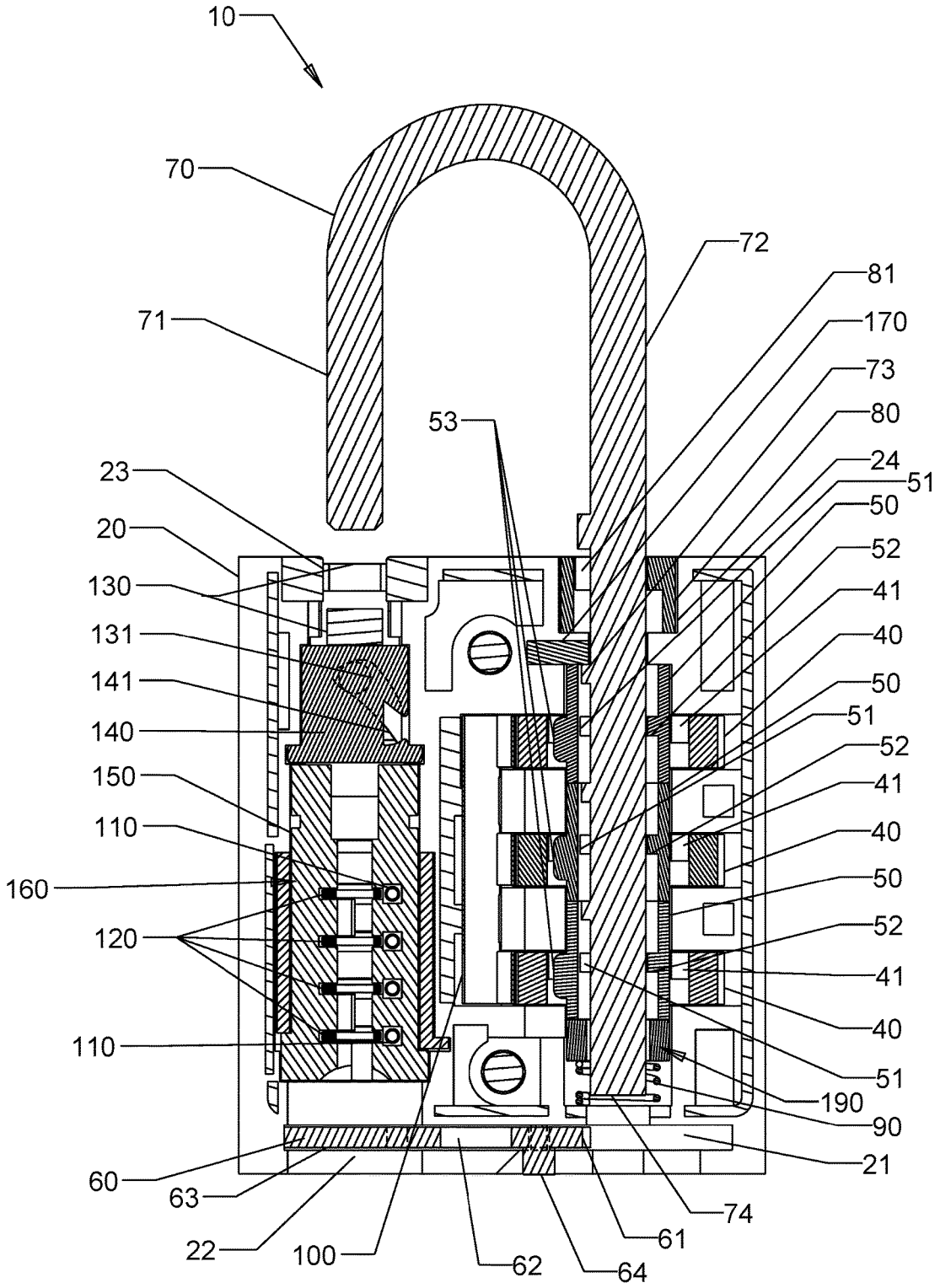
FIG. 7 shows the padlock according to a first embodiment of the invention in unlocked mode by combination with the control plate in blocking mode.

FIG. 7 shows an example of the padlock 10 being unlocked by the combination mechanism 190 with the control plate 60 in the blocking mode.

The dials 40 have teeth 41 that receive the extended fins 53 of the clutch 50. The teeth 41 and extended fins 53 are engaged with each other during the unlock combination mode. A ratchet plate 100 is provided for providing a ratchet sound and feel when the dials 40 are turned. When the dials 40 are aligned to the open lock combination, the opening-gap 51 of the clutch 50 will align with the protrusion 73 of the shackle 70. Because there is nothing to prevent the protrusion 73 from being pulled upward, the user can then pull the shackle 70 upward to release the shackle 70 out of the locking hole 23 of the lock body 20. The lock body 20 is provided with a hole 24, configured to receive a top cap 80. The top cap 80 contains a slot 81 to allow the protrusion 73 to pass through. The shackle 70 will be pulled upward until the protrusion 73 of the shackle 70 contacts the shackle retaining plate 170. In the unlock by combination mode, the long leg tip 74 of the shackle 70 will move away from the second cut out section 61 of the control plate 60, which then can allow the user to slide the control plate 60 from blocking the key entrance hole 22, to expose the key entrance hole 22.

Figure 8:
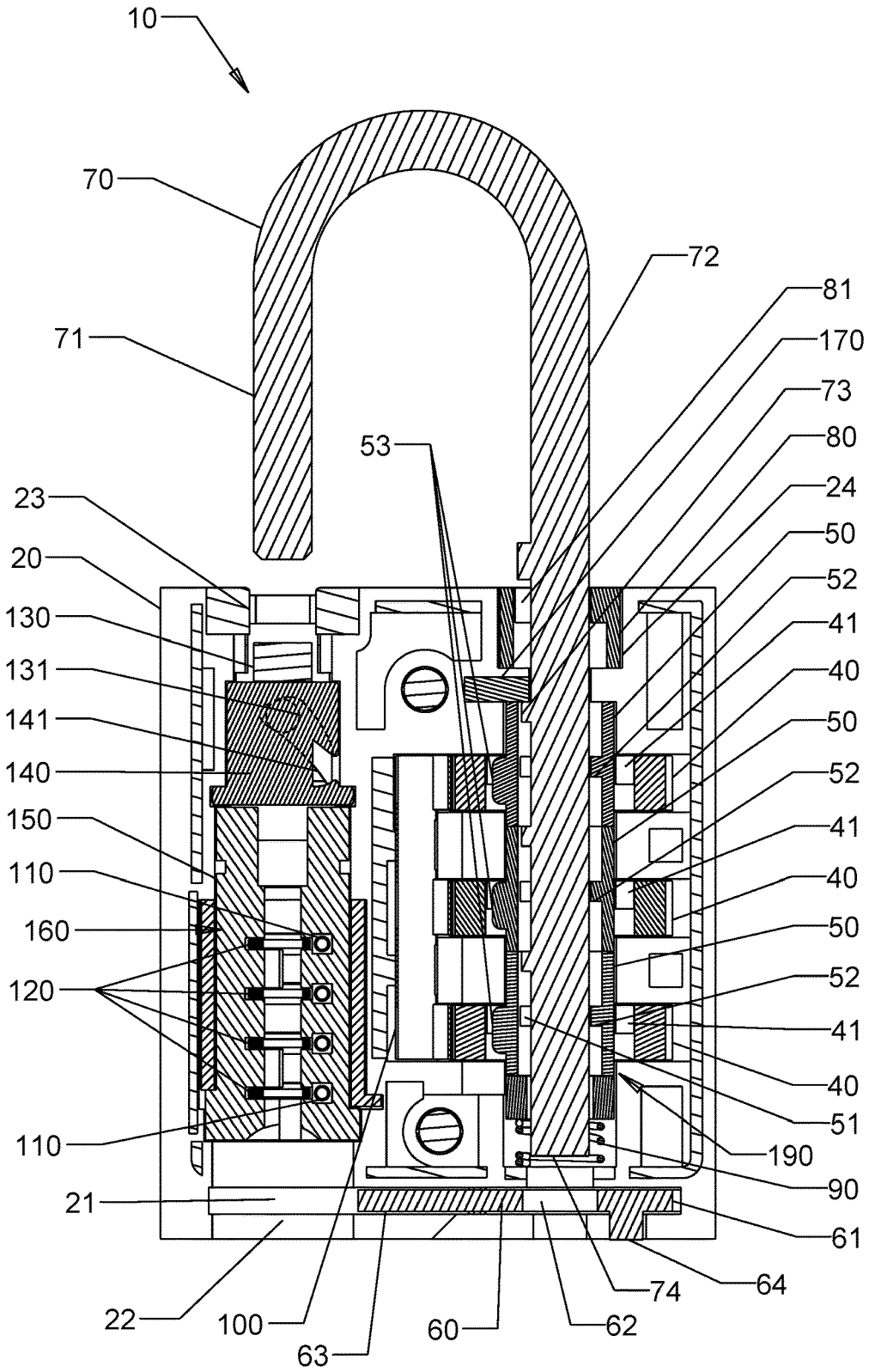
FIG. 8 shows the padlock according to a first embodiment of the invention in unlocked mode by combination with the control plate in exposure mode.

FIG. 8 shows the unlock by combination mechanism of the padlock 10 with control plate 60 in exposure mode.

When the control plate 60 has slid to the exposure mode, the first cut out section 62 of the control plate 60 aligns to the long leg tip 74 of the shackle 70. When the user closes the shackle 70, the long leg tip 74 of the shackle 70 will engage into the first cut out section 62 of the control plate 60, which will prevent the control plate 60 from moving from exposure mode to blocking mode. As in such position, the wall 63 of the control plate 60 is moved rightward (relative to the orientation shown in FIG. 8) and the key entrance hole 22 of the lock body 20 becomes exposed. This allows the padlock 10 to be opened, for example, by a TSA inspector to inspect the luggage at a security check point.

The movement of the control plate 60 is only allowed by the combination mechanism 190 being in open position. This means that to move the control plate 60, the combination mechanism 190 must be in the lock open mode, wherein the shackle 70 is being pulled upward. If the shackle 70 is in upward position, then the user can freely slide the control plate 60 by pushing or pulling the projection 64 into the desired position. If the user wants a TSA officer to inspect luggage freely, then he or she can slide the control plate 60 such that the wall 63 of the control plate 60 will not block the key entrance hole 22 of the lock body 20. In such cases, the user can close the shackle 70 in the exposure mode (i.e., to allow the user to inspect luggage), the long leg tip 74 of the shackle 70 will engage into the first cut out section 62 of the control plate 60.

If the user does not want anyone to open his or her luggage by the key mechanism 160, then in the lock open mode via combination mechanism 190, he or she can slide the control plate 60 leftward such that the wall 63 of the control plate 60 blocks the key entrance hole 22 of the lock body 20. In such cases, the user can close the shackle 70 into blocked mode (which prevents access to the cylinder 150 and key mechanism 160 of the padlock 10), and the long leg tip 74 of the shackle 70 engages the second cut out section 61 of the control plate 60.

Figure 2:
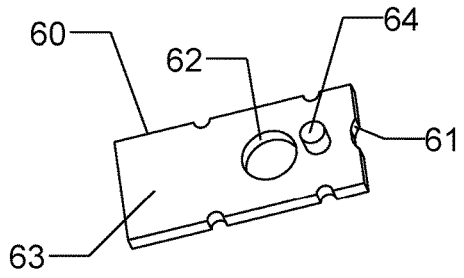
FIG. 2 shows a control plate of the padlock according to the first embodiment of the invention.
Figure 3:
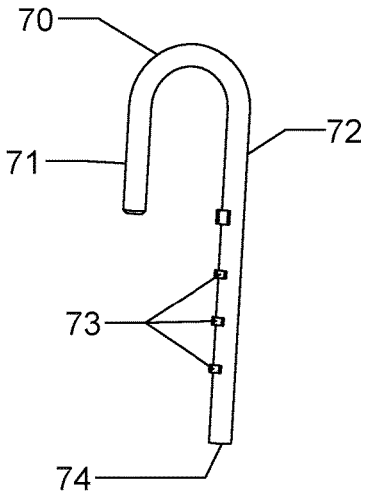
FIG. 3 shows a shackle of the padlock according to the first embodiment of the invention.

In both cases, once the long leg tip 74 of the shackle 70 engages to one of the cut out section 61 or 62 of the control plate 60, the control plate 60 will not be able to slide to another mode. The first and second cut out sections 62 and 61 of the control plate 60 can be holes through the control plate 60, formations into an edge of the control plate 60, or a combination of the two, as shown for example in FIG. 2. The hole 62 through the control plate 60 is dimensioned for receiving the long leg tip 74 of the shackle 70, so as to secure the long leg 72 in the control plate 60. The cut out section 61 along the edge of the control plate 60 can be curved in a curvature similar to that of the long leg 72 of the shackle. In alternative embodiments, only a single cut out section 62 may be utilized.

Figure 9:
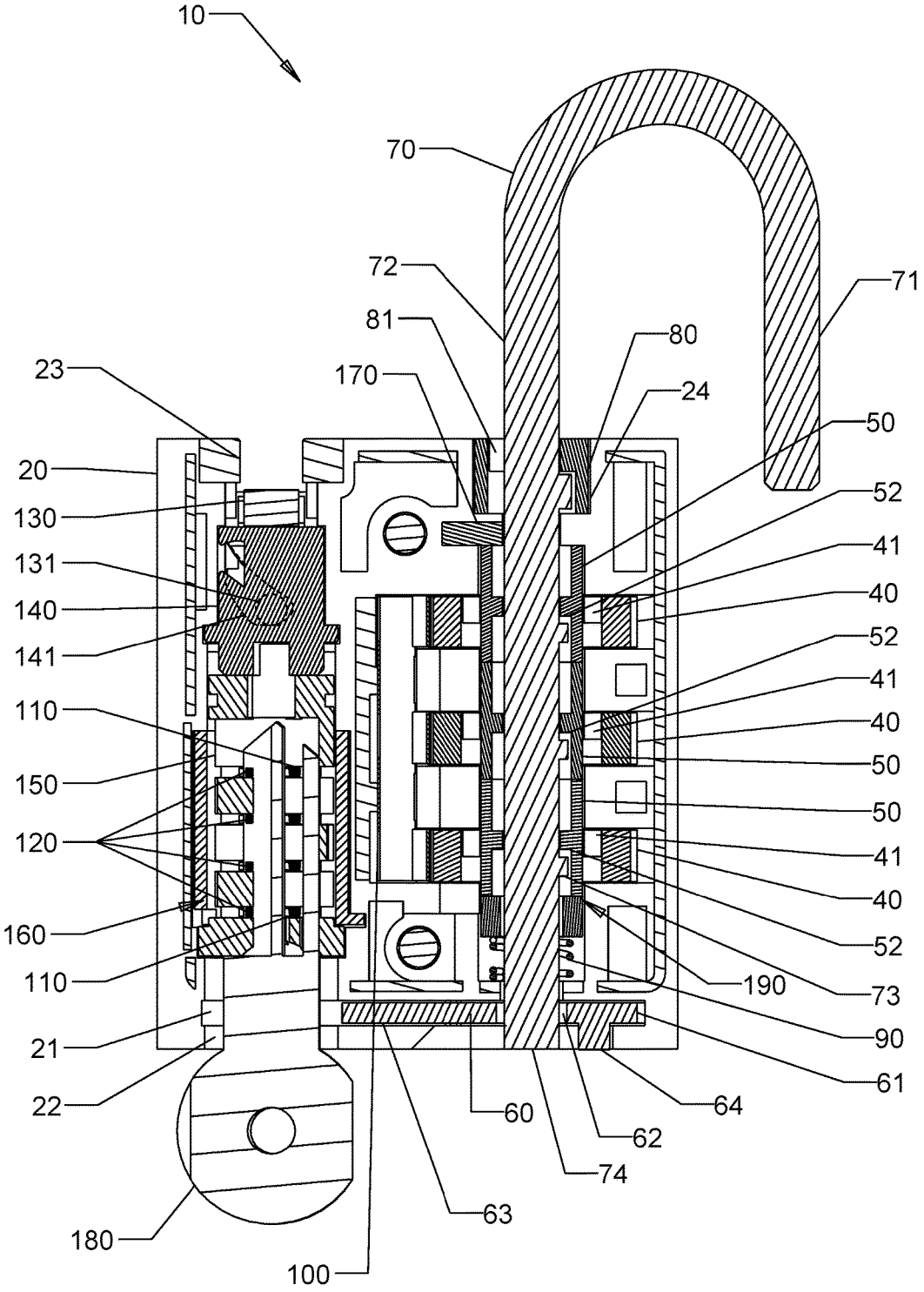
FIG. 9 shows the padlock according to a first embodiment of the invention in unlocked mode by key with the control plate in exposure mode.

FIG. 9 shows an example of the padlock 10 unlocked by the key 180 with control plate 60 in the exposure mode.

When the control plate 60 is in the exposure mode, the wall 63 of the control plate 60 is not blocking the key entrance hole 22. As a correct key 180 is inserted into the cylinder 150, then the user can turn the cylinder 150 causing the cam 140 to rotate and the pin 131 of the blocking plate 130 will be driven downward by the slot 141 of the cam 140. The cylinder 150 can be provided with an arrangement of springs 110 and wafer plates 120. The short-leg 71 of shackle 70 can swing out from the locking hole 23 of the lock body 20 to open the padlock 10. The shackle 70 is not being pulled upward, which means that the long leg tip 74 of the shackle 70 still engages to the second cut out hole 62 of the control plate 60, which means that although the padlock 10 is in open mode via key mechanism 160, the user cannot slide the control plate 60 from exposure mode to blocking mode.

Figure 10:
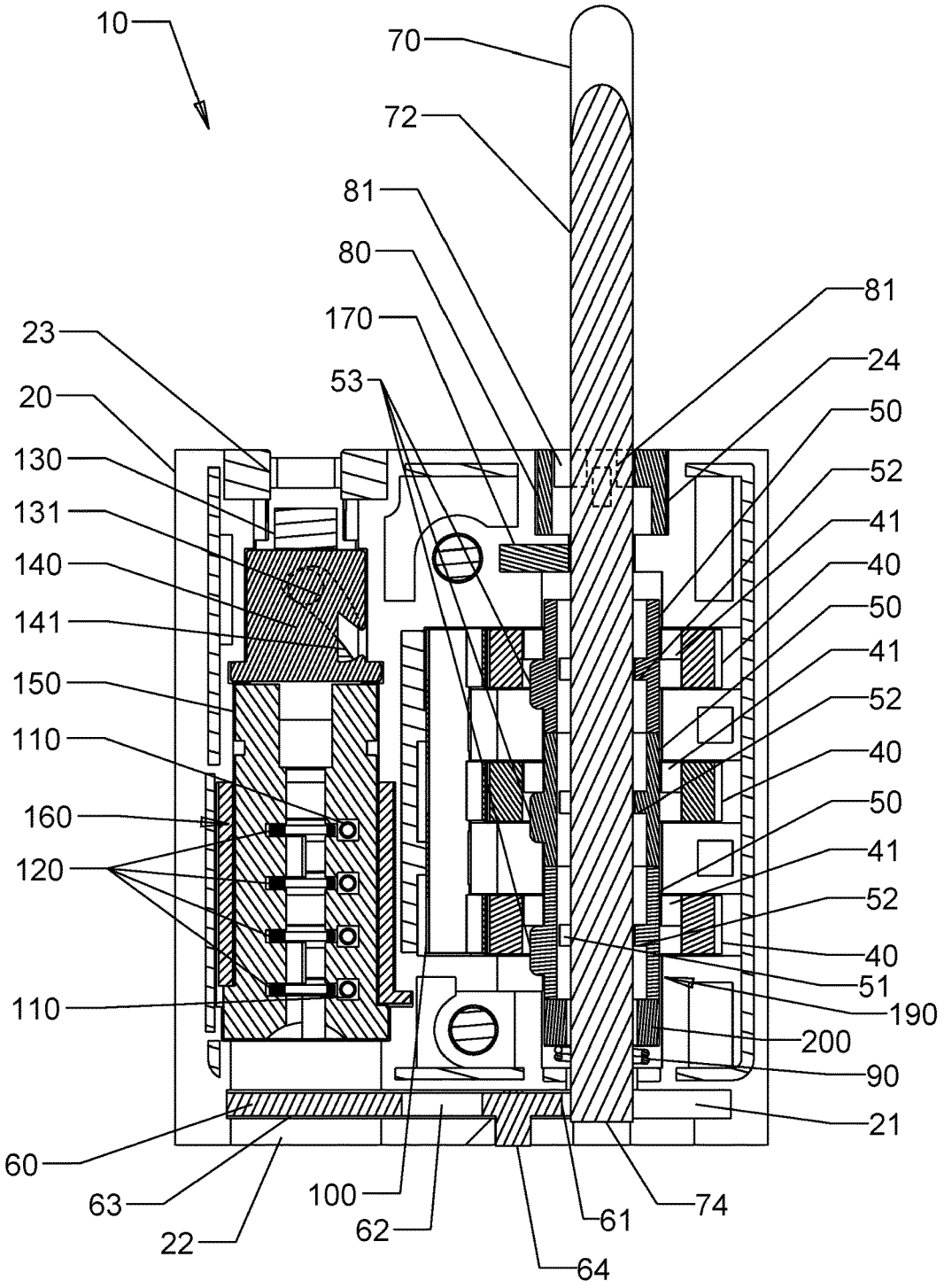
FIG. 10 shows the padlock according to a first embodiment of the invention in combination reset mode with the control plate in blocking mode.

FIG. 10 shows the combination of the padlock 10 being reset with control plate 60 in the blocking mode.

While the shackle 70 is pulled upward in the lock open-mode by combination mechanism 190, the shackle 70 can rotate freely. The user can turn the shackle 70 at a pre-designated angle (in this example, clockwise ninety degrees) and push the shackle 70 downward. As the shackle 70 is being pushed downward, the protrusion 73 of the shackle 70 will push the clutches 50 downward. As the clutches 50 move downward, the extended fins 53 of the clutch 50 are no longer engaging the teeth 41 of the dials 40, the user can turn the dials 40 to a new combination. After the user sets the combination, the user can then release the shackle 70. The spring 90 underneath the spacer ring 200 will push the spacer ring 200 and the clutches 50 upward. As the clutches 50 move back to the original position, the extending fin 53 of the clutch 50 will engage back to the teeth 41 of the dials 40.

Figure 11:
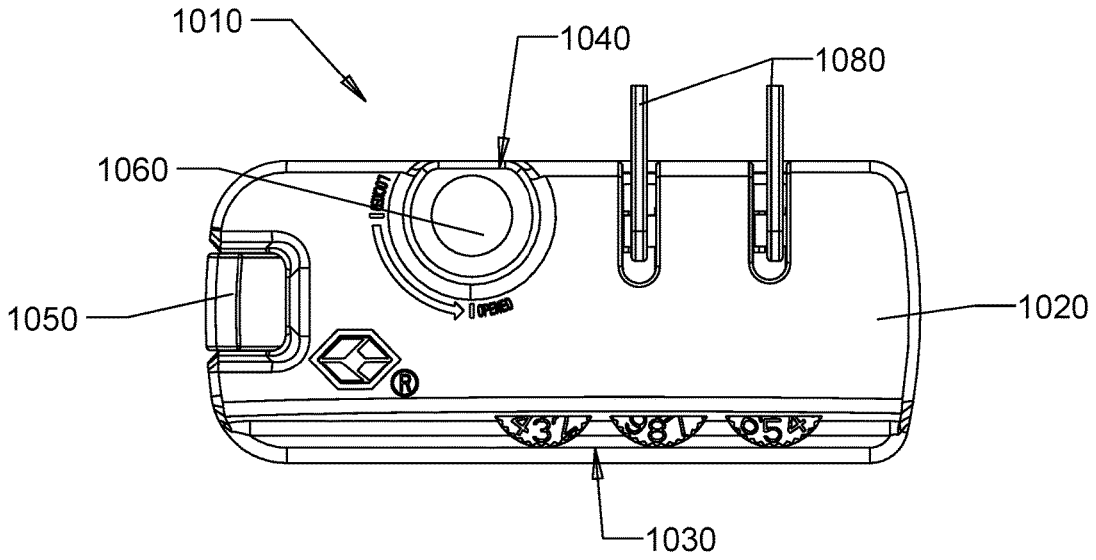
FIG. 11 shows a luggage zipper lock according to a second embodiment of the invention with a control plate in blocking mode.
Figure 12:
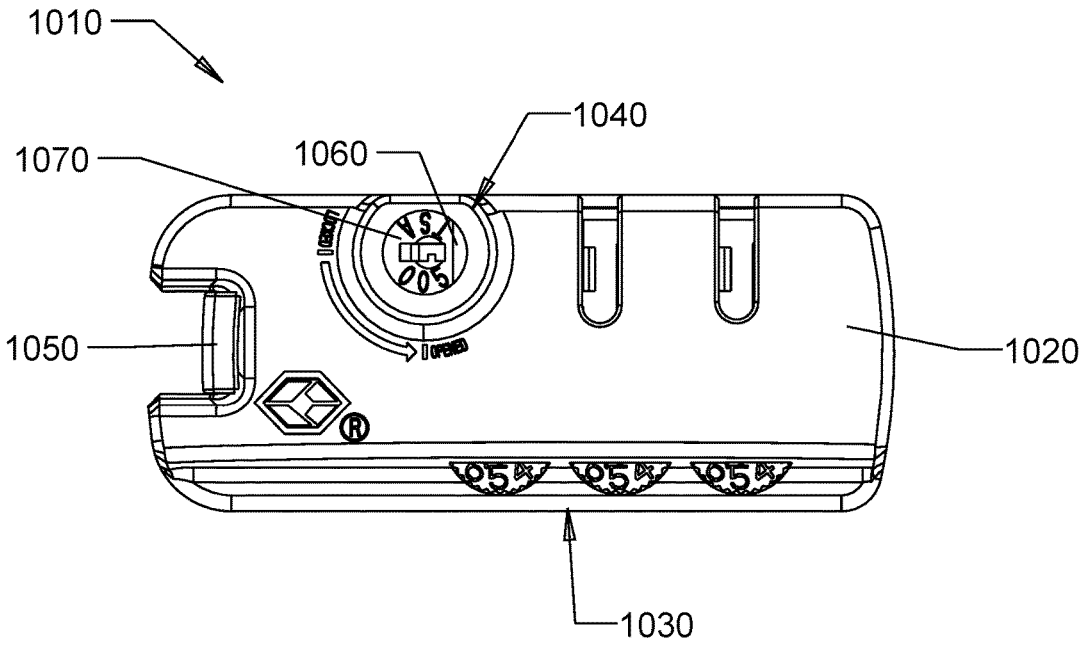
FIG. 12 shows the luggage zipper lock according to a second embodiment of the invention with a control plate in exposure mode.

In a second embodiment of the invention, shown in FIGS. 11 and 12, a luggage zipper lock 1010 is providing containing a lock body 1020. Inside the lock body 1020 there is a combination mechanism 1030 and a key mechanism 1040. A push button 1050 forms part of the combination mechanism 1030, wherein when the zipper lock 1010 is in the lock open code (FIG. 12), the push button 1050 can be pushed inside to unlock the zipper lock 1010 and also unlock the control plate 1060. The locking and unlocking functionality of the zipper lock 1010 may be similar to that shown and described in applicant's U.S. Pat. No. 8,661,861.

In the mode shown in FIG. 11, the cylinder 1070 is concealed behind the control plate 1060. When the user unlocks the zipper lock 1010 by combination mechanism 1030, the zipper lock 1010 will unlock the latches 1080 and also be capable of making the control plate 1060 switch from blocking mode (FIG. 11) to exposure mode (FIG. 12).

When the zipper lock 1010 is in exposure mode, then the zipper lock allows a TSA agent to inspect the luggage if needed. The user can switch the control plate 1060 to blocking mode by sliding the control plate 1060. In one embodiment, there may an internal latch attached to the control plate 1060 such that when the control plate 1060 is in locked mode the latch will push toward the control plate 1060 and will not allow anyone to slide the control plate. When the user turns the dials of the combination mechanism 1030 to the correct combination and pushes the button 1050 inward, it will allow the latch to move away from the control plate 1060, and then the user can use another hand to slide the control plate 1060 to move from lock to open position, or from lock to open position.

It is noted that where directional terms are used above, such as "above," "below," "left," "right," "up" or "down," these terms are used solely for explanatory purposes and are relative to the orientation of the padlock 10 in the Figures.

While there have been shown and described and pointed out fundamental novel features of the invention as applied to preferred embodiments thereof, it will be understood that various omissions and substitutions and changes in the form and details of the devices and methods described may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto. Furthermore, in the claims meansplus-function clauses are intended to cover the structures described herein as performing the recited function and not only structural equivalents, but also equivalent structures. Thus although a nail and a screw may not be structural equivalents in that a nail employs a cylindrical surface to secure wooden parts together, whereas a screw employs a helical surface, in the environment of fastening wooden parts, a nail and a screw may be equivalent structures.

What is claimed:

1. A locking apparatus comprising:

a primary locking mechanism comprising a combination mechanism;

a secondary locking mechanism comprising a key mechanism comprising a key entrance hole; and a control plate configured to block access to the key entrance hole in a first, blocking position;

wherein the combination mechanism is configured to control movement of the control plate by permitting movement of the control plate to a second, exposure position to expose the key entrance hole when the locking apparatus is opened by the combination mechanism;

wherein the locking apparatus is a padlock comprising:

a lock body; and a shackle, wherein a first, long leg of the shackle is retained inside the lock body and a second leg of the shackle can be released from the lock body from a first locked position to a second opened position by upward movement, when the padlock is opened by the combination mechanism or the key mechanism;

wherein the control plate comprises at least one cut out section and a wall configured to block access to the key hole; and wherein when the control plate is in the first, blocking position, the long leg of the shackle is engaged with the control plate in a manner that prevents movement of the control plate.

2. The locking apparatus according to claim 1, wherein opening the padlock by way of the combination mechanism releases the long leg of the shackle from engagement with the control plate and permits movement of the control plate in a first direction out of the first, blocking position.

3. The locking apparatus according to claim 2, wherein movement of the control plate in the first direction is configured to align the long leg of the shackle and a first cut out section of the control pate, such that a subsequent locking of the padlock causes the long leg of the shackle to engage the first cut out section of the control plate in a manner that prevents movement of the control plate, and secures the control plate in the second, exposure position.

4. The locking apparatus according to claim 3, wherein opening the padlock by way of the combination mechanism releases the long leg of the shackle from the first cut out section of the control plate and permits movement of the control plate in a second direction toward the first, blocking position.

5. The locking apparatus according to claim 3, wherein the first cut out section of the control plate is a hole through the control plate dimensioned to receive the long leg of the shackle.

6. The locking apparatus according to claim 1, wherein the when the control plate is in the first, blocking position, the long leg of the shackle is engaged with a second cut out section of the control plate in a manner that prevents movement of the control plate.

7. The locking apparatus according to claim 1, further comprising a plurality of clutches;

a plurality of dials to control rotational movement of the plurality of clutches;

a cam;

a cylinder connected to the cam and configured to control movement of the cam; and a blocking plate connected to the cam and configured to control the movement of the second leg of the shackle.

8. The locking apparatus according to claim 1, wherein the control plate further comprises a projection configured to assist in movement of the control plate.

9. The locking apparatus according to claim 1, wherein the locking apparatus is a zipper lock.

* * * * *